United States Patent [19]

Larson et al.

[11] 4,237,358

[45] Dec. 2, 1980

[54] ISOLATION MEMBRANE SWITCH

[75] Inventors: Willis A. Larson, Crystal Lake; Steven D. Vannice, Marengo; Joseph E. Jesson, Lake Villa, all of Ill.

[73] Assignee: Oak Industries Inc., Crystal Lake, Ill.

[21] Appl. No.: 36,353

[22] Filed: May 7, 1979

[51] Int. Cl.[3] ..... H01H 3/02; H01H 3/12

[52] U.S. Cl. ..... 200/159 B; 200/86 R

[58] Field of Search ..... 200/159 B, 86 R

[56] References Cited

U.S. PATENT DOCUMENTS

| | | | |
|---|---|---|---|
| 3,617,660 | 11/1971 | Krakinowski | 200/159 B X |
| 3,862,381 | 1/1975 | Glaister et al. | 200/159 B X |
| 4,066,850 | 1/1978 | Heys, Jr. | 200/159 B X |
| 4,128,744 | 12/1978 | Seeger | 200/159 B X |

*Primary Examiner*—Steven M. Pollard

*Attorney, Agent, or Firm*—Kinzer, Plyer, Dorn & McEachran

[57] ABSTRACT

A membrane switch includes a substrate having a plurality of first conductors formed thereon and a flexible membrane having a plurality of second conductors formed thereon. A spacer is positioned between the substrate and membrane and there are openings in the spacer in register with aligned first and second conductors. To isolate the switch membrane, there is a pressure reduction membrane overlying and in contact with the exterior of the switch membrane and an isolation membrane positioned on top of the pressure reduction membrane. Areas of the pressure reduction membrane in register with the spacer openings are formed to reduce the required force thereupon to effect movement of the switch membrane.

5 Claims, 6 Drawing Figures

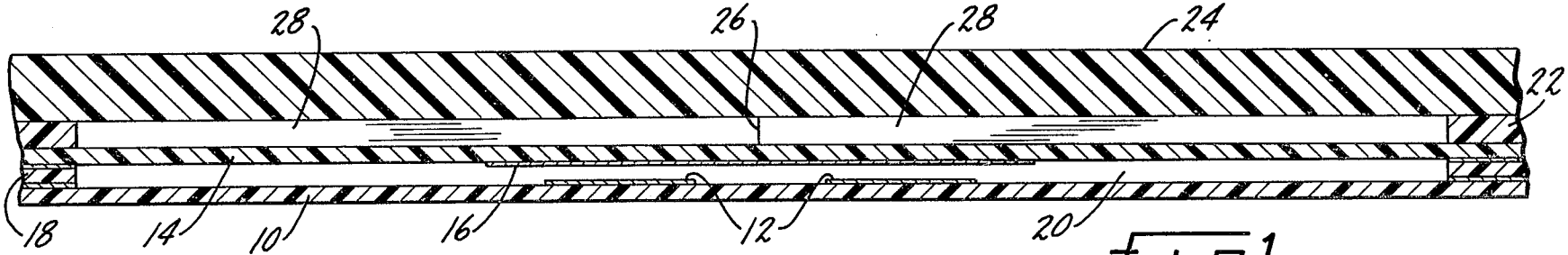
FIG. 1.
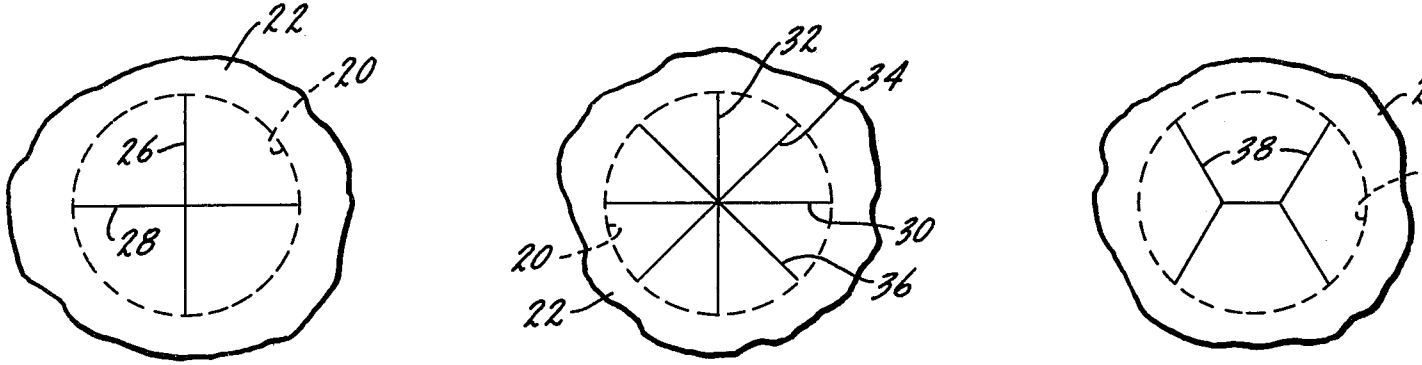
FIG. 2.
FIG. 3.
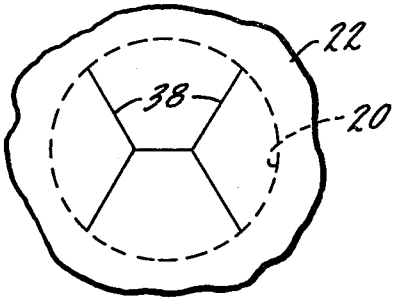
FIG. 4.
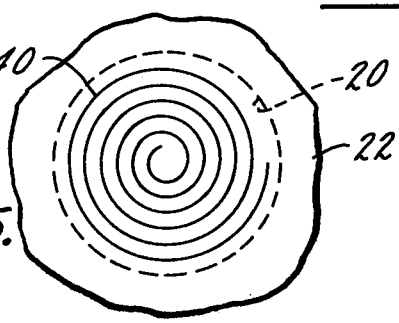
FIG. 5.
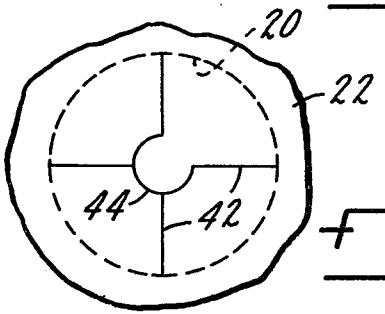
FIG. 6.

ISOLATION MEMBRANE SWITCH

SUMMARY OF THE INVENTION

The present invention relates to membrane switches and in particular to such a switch which provides complete isolation between the object causing operation of the switch and the interior electrical conductors.

Another purpose is a membrane switch having isolation layers thereupon so as to completely insulate the interior electrical conductors from the exterior of the switch.

Another purpose is a membrane switch of the type described in which a pressure reduction membrane is interposed between the switch membrane and an isolation membrane, which pressure reduction membrane has areas, in alignment with the electrical conductors, which reduce the force required to operate the switch.

Another purpose is a membrane switch having isolation means thereon in which a portion of the isolation means has slits of various configurations to permit ease in switch operation.

Other purposes will appear in the ensuing specification, drawings and claims.

BRIEF DESCRIPTION OF THE DRAWINGS

The invention is illustrated diagrammatically in the following drawings wherein:

FIG. 1 is a section through a switch of the type described,

FIG. 2 is a plan view illustrating one form of pressure reduction area,

FIG. 3 is a similar plan view indicating a second form of pressure reduction area, FIG. 4 is a further similar plan view illustrating a pressure reduction area, FIG. 5 is a similar plan view illustrating yet a further form of pressure reduction area, and FIG. 6 is yet a further plan view illustrating an additional form of pressure reduction area.

DESCRIPTION OF THE PREFERRED EMBODIMENT

The present invention concerns membrane switches of the type generally shown in my prior U.S. Pat. Nos. 3,988,551 and 4,017,697, as well as several similar patents relating to the same subject matter.

With the introduction of microprocessors and other sophisticated, relatively inexpensive electronics, switching functions can now be reduced to the opening and closing of contacts, permitting a simplified and more reliable switch construction. The membrane switch disclosed herein is specifically directed to this concept wherein there is only an opening and closure of a switch contact with more sophisticated switching functions being carried on by the auxiliary electronics.

One method of making an economical membrane switch uses conductors which are painted, printed, or silk screened onto one or more adjacent surfaces, customarily the supporting substrate and the movable membrane. In this connection, although the present application will disclose a membrane switch in which the supporting substrate is also a flexible membrane, it should be understood that the principles disclosed herein are equally applicable to a membrane switch in which the substrate is rigid.

There are applications in which the electrical conductors of a membrane switch may perform a switching function for an electrical circuit utilizing substantially high voltages. Thus, those voltages will be present within the membrane switch itself. Although membrane switches are customarily completely sealed and there is little likelihood that the human finger, when operating the switch, could actually come in contact with one of the interior conductors, it is not an impossibility. Membrane switches by their nature are subject to injury from a sharp object and thus it is possible for the operator of the switch to come in contact with the interior conductors if the switch has been damaged in any way. The present invention provides a means for completely isolating the electrical conductors, which isolation is so arranged that not only is no additional force by the operator required to operate the switch, but, in fact, the switch may be operated by a somewhat reduced application of pressure.

In essence, the membrane switch is isolated by the application of two exterior layers which are positioned against the exterior of the membrane which normally would receive the operator's finger for switch operation. The first layer or pressure reduction membrane has areas, in register with the membrane switch spacer openings, which reduce the force required to cause the pressure reduction membrane to move inwardly, upon the application of force, to effect operation of the membrane switch in the customary manner. These areas of reduced force required may take a number of forms and the most practical is to provide slits completely or at least partially through the thickness of this layer in the areas of the membrane switch spacer openings. The pressure reduction membrane is covered in turn by a somewhat thicker layer, for example of a polyester material, which will be continuous and will have no openings, cuts, slits or the like, and thus will provide complete isolation between the operator and the switch.

In FIG. 1 the conventional portions of the membrane switch include a substrate 10, which may have a thickness of 0.005 inch and which has electrical conductors in defined areas 12. The conductors 12 may be painted, printed or silk screened onto the substrate in any one of a number of conventional processes. Silver is a useful metal for the conductors although other materials may be equally effective. A membrane 14, again which may have a thickness of approximately 0.005 inch, is positioned opposite the substrate and has electrical conductors 16 formed thereon, which conductors may be formed in the same manner as with the substrate. A spacer 18 is positioned between the membrane and substrate and will have openings 20 in register with the areas of the aligned conductors 12 and 16. Only one such opening is shown herein, but it should be understood that the switch will have a large number of such openings, depending upon the required switching functions for a particular application. The spacer may have the same thickness as the substrate and membrane, although obviously this is not required. The sandwich of membrane, substrate and spacer will be held together by adhesive in the normal manner.

In normal application, a force is applied to the exterior of the membrane in the area of the spacer opening and such force causes the membrane to move toward the substrate until there is electrical contact between the conductors of the membrane and the substrate. Normally, the conductors will have current paths, usually painted conductors which run to an exterior tail by which the switch is connected to its associated electrical equipment.

A layer 22, which may be termed a pressure reduction membrane, is applied to the exterior of membrane 14 and may be formed of a polyester material and will have a pressure reduction area, to be described in detail hereinafter, in alignment with each spacer opening. The pressure reduction membrane may have a thickness of 0.010 inch, although the invention should not be so limited. Positioned exteriorly of the pressure reduction membrane is an isolation membrane 24, for example having a thickness of from 0.020 to 0.030 inch and which also may be formed of a polyester material.

The pressure reduction areas may be formed in various ways. A convenient process provides crossed slits, indicated at 26 and 28 and illustrated in FIG. 2. The slits may go completely through the pressure reduction membrane in the area of the spacer openings or such slits may be only partial.

FIG. 3 shows a modified form in which there are four slits designated 30, 32, 34 and 36, which slits divide the area into eight generally equal areas.

A third configuration is illustrated in FIG. 4 in which there are slits 38 which divide the area into quadrants unequal in size.

A fourth configuration is illustrated in FIG. 5 in which there is a single slit which is formed somewhat in the shape of a spiral and indicated at 40.

Yet a further configuration is indicated in FIG. 6 in which there are four radially extending slits 42, each of which is connected to a partial circular slit 44.

In every instance the slits illustrated in FIGS. 2-6 effectively reduce the force that is required to move the pressure reduction membrane in the area of the slits. Thus, pressure applied exteriorly of the isolation membrane can provide switch operation movement to membrane 14 without the application of any additional force over that normally required to operate a membrane switch. The slits simply make it easier for the pressure reduction membrane to move inwardly in the area of the slits as exterior pressure operates the switch. In fact, it has been established that because of the pressure reduction areas in the pressure reduction membrane, there is actually less force required to effect operation of the switch than if there were no pressure reduction membrane or isolation membrane on the exterior of membrane 14. The slits, or other configurations performing the same function simply permit sufficient ease of switch operation so that the isolation membrane and the pressure reduction membrane do not in any sense detract from the normal operation of the membrane switch.

Whereas the preferred form of the invention has been shown and described herein, it should be realized that there may be many modifications, substitutions and alterations thereto.

The embodiments of the invention in which an exclusive property or privilege is claimed are as follows:

1. In a membrane switch, a substrate, a plurality of first conductors formed on said substrate, a flexible switch membrane, a plurality of second conductors formed on said switch membrane, a spacer positioned between said substrate and switch membrane, openings in said spacer in register with aligned first and second conductors, a pressure reduction membrane overlying and in contact with the exterior of said switch membrane, said pressure reduction membrane being at least partially slit in areas in register with said spacer openings, and an isolation membrane overlying said pressure reduction membrane, the application of pressure to said isolation membrane in areas in alignment with said spacer opening causing said switch membrane to move toward said substrate through a spacer opening to effect contact between aligned first and second conductors.

2. The membrane switch of claim 1 further characterized in that said pressure reduction membrane is slit completely through in the areas of said spacer openings.

3. The membrane switch of claim 1 further characterized by and including a plurality of slits in register with each spacer opening in said pressure reduction membrane.

4. In a membrane switch, a substrate, a plurality of first conductors formed on said substrate, a flexible switch membrane, a plurality of second conductors formed on said switch membrane, a spacer positioned between said substrate and switch membrane, openings in said spacer in register with aligned first and second conductors, a pressure reduction membrane overlying and in contact with the exterior of said switch membrane, an isolation membrane overlying and in contact with the exterior of said pressure reduction membrane, the application of force on said isolation membrane in the area of said spacer openings causing said switch membrane to move toward said substrate to effect contact between said first and second conductors, said pressure reduction membrane having areas in register with said spacer openings, formed to require reduced force to effect such movement of the switch membrane.

5. The membrane switch of claim 4 further characterized in that said areas, in register with said spacer openings, formed to require reduced force, include at least one slit in said pressure reduction membrane.

* * * * *